US006958739B2

(12) United States Patent
Moon

(10) Patent No.: US 6,958,739 B2
(45) Date of Patent: Oct. 25, 2005

(54) AGING APPARATUS OF FIELD EMISSION DEVICE AND METHOD THEREOF

(75) Inventor: Seong Hak Moon, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 10/693,998

(22) Filed: Oct. 28, 2003

(65) Prior Publication Data

US 2004/0085307 A1 May 6, 2004

(30) Foreign Application Priority Data

Oct. 29, 2002 (KR) ..... 10-2002-0066254

(51) Int. Cl.[7] ..... G09G 3/20
(52) U.S. Cl. ..... 345/75.2; 445/5; 315/169.1
(58) Field of Search ..... 345/55, 74–80, 345/97; 315/169.1–169.4; 445/5, 6; 219/121.52; 359/293

(56) References Cited

U.S. PATENT DOCUMENTS 4,515,569 A * 5/1985 Hernqvist ..... 445/5
5,667,705 A * 9/1997 Miyazaki et al. ..... 219/121.52
6,034,810 A * 3/2000 Robinson et al. ..... 359/293
6,144,350 A * 11/2000 Fujii et al. ..... 345/74.1
6,259,422 B1 * 7/2001 Hamamoto ..... 345/74.1

* cited by examiner

*Primary Examiner*—Wilson Lee
(74) *Attorney, Agent, or Firm*—Fleshner & Kim, LLP

(57) ABSTRACT

Disclosed are an aging apparatus of a field emission device and a method thereof. The apparatus comprises an aging operation controlling unit for converting a direct current high voltage applied to an anode electrode into a high voltage of a pulse form, gradually increasing the converted high voltage of a pulse form with a certain interval and thus applying to the anode electrode, and performing an aging operation by controlling a voltage applied to a scan driving unit. According to this, arc is prevented, an entire panel aging time is reduced, and energy consumption is reduced.

9 Claims, 3 Drawing Sheets

AGING APPARATUS OF FIELD EMISSION DEVICE AND METHOD THEREOF

BACKGROUND OF THE INVENTION

1. Field of the Invention

The present invention relates to a field emission device, and more particularly, to an aging apparatus of a field emission device capable of preventing arc by applying an alternating current pulse at the time of an aging operation.

2. Description of the Conventional Art

As an information processing system develops and widely spreads, an importance of a display device as a display information transmitting means is being spotlighted.

A cathode ray tube (CRT), one of the conventional display devices, has disadvantages that its size is large and an image display distortion due to an earth magnetic field is generated. Each kind of recent display device has a goal of a large screen, a flat screen, a high brightness, and a high efficiency. According to this, each kind of flat panel display device is being briskly researched. As the flat panel display device, a liquid crystal display (LCD) device, a plasma display panel (PDP) device, a field emission display (FED) device, and etc. are being developed.

Generally, the field emission display device has a region of a high vacuum for emitting an electron between an upper substrate and a lower substrate where a high voltage is applied, that is, between an anode and a cathode. When an FED vacuum tube is fabricated for construction of the high vacuum region, a small quantity of contaminants adhering to surfaces of emissive elements, faceplates, gate electrodes, spacer walls, and etc. can be generated. If a field emitting device including said contaminants therein is driven, electrons are bombarded with said contaminants thus to generate a phenomenon that particles of the contaminants are knocked off the surfaces.

According to said phenomenon, a high ionization pressure region is formed in the vacuum tube thus to catalyze an electron emission between a scan electrode and a gate electrode. A part of the emitted electrons is not emitted to the anode but hits the gate electrode, thereby overheating the gate electrode or badly influencing on a voltage difference formation between the gate electrode and an emitter electrode. When the gate electrode is overheated, a brightness discharge current exceeding an energy gap between a scan electrode and the gate electrode is formed thus to damage the scan electrode severely, thereby reducing a lifespan of the field emission device. This phenomenon is called as an arc.

In order to prevent said arc phenomenon, contaminants inside of a panel are removed and a pressure is lowered, that is, a high vacuum state is maintained.

Meanwhile, in order to remove contaminants of the conventional field emission device, getter for absorbing contaminants was included in the panel thus to absorb contaminants at the time of driving the field emission device.

However, the method for absorbing contaminants by getter is limited. That is, a capacity difference of getter is great according to a size of the field emission device, and contaminants can not be absorbed any more at a saturated state.

In order to solve said problems generated at the time of using getter, an aging operation using a direct current voltage is being performed recently to remove contaminants of a high vacuum region. That is, by applying a direct current high voltage which gradually increases to the anode, contaminants adhering to a surface of the high vacuum region are separated. The separated contaminants are exhausted to outside by a vacuum pump thus to remove contaminants.

However, according to the conventional aging method, when a direct current voltage is applied to the field emission device, very high energy is charged in the field emission device and arc due to a high electric field is frequently generated thus to damage the device and thereby to lower a lifespan.

SUMMARY OF THE INVENTION

Therefore, an object of the present invention is to provide an aging apparatus of a field emission device capable of preventing arc and reducing an entire panel aging time by converting a direct current high voltage inputted to an anode electrode into an alternating current high voltage of a pulse form, gradually increasing with a constant interval, and thereby applying to the anode, and a method thereof.

To achieve these and other advantages and in accordance with the purpose of the present invention, as embodied and broadly described herein, there is provided an aging apparatus of a field emission device provided with a scan driving unit and a panel, the apparatus comprising an aging operation controlling unit for performing an aging operation by controlling a high voltage of a pulse form applied to an anode electrode of the panel and a voltage applied to the scan driving unit.

To achieve these and other advantages and in accordance with the purpose of the present invention, as embodied and broadly described herein, there is provided an aging method of a field emission device provided with a scan driving unit and a panel, the method comprising: a pre-aging for switching a direct current high voltage applied to an anode electrode of the panel and thereby outputting as an alternating current high voltage of a pulse form; and a main aging for controlling a voltage applied to the scan driving unit.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENTS

Reference will now be made in detail to the preferred embodiments of the present invention, examples of which are illustrated in the accompanying drawings.

An aging apparatus of a field emission device and a method thereof according to the present invention will be explained with reference to attached drawings.

Figure 1:
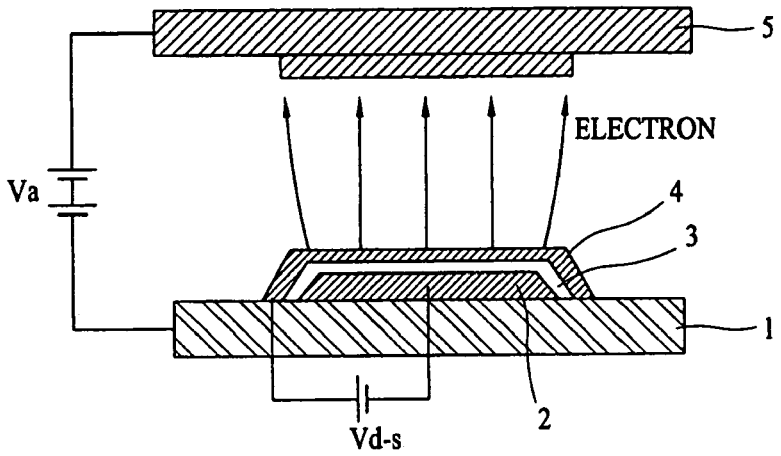
FIG. 1 is a schematic section view of a field emission device for performing an aging operation according to the present invention.

FIG. 1 is a schematic section view of a field emission device for performing an aging operation according to the present invention.

As shown in FIG. 1, in the field emission device, a scan electrode 2, an insulating layer 3, and a data electrode 4 are sequentially stacked on a lower substrate glass 1. An anode electrode 5 is separated from the data electrode 4 and positioned with facing the data electrode 4. Herein, a gap between the data electrode 4 and the anode electrode 5 is a high vacuum state. The high vacuum state is not sealed but maintains a high vacuum state by a vacuum pump.

Operation of the field emission device will be explained as follows.

First, a certain voltage Vd-s is applied to the data electrode 4 and the scan electrode 2. According to this, electrons are emitted from the scan electrode 2 and the electrons are emitted through the insulating layer 3 and the data electrode 4 by a quantum mechanics tunnel effect. Herein, the certain voltage Vd-s controls an intensity of an electron. Accordingly, when the voltage Vd-s is high, a quantity of the electrons emitted from the scan electrode is great, and when the voltage Vd-s is low, a quantity of the electrons emitted from the scan electrode is less.

Then, the emitted electrons is accelerated towards an anode electrode where a fluorescent material is deposited by an anode voltage Va. When the electrons are bombarded with the fluorescent material, energy is generated and thereby electrons on the fluorescent material are knocked off after an excited state thus to emit light.

Figure 2:
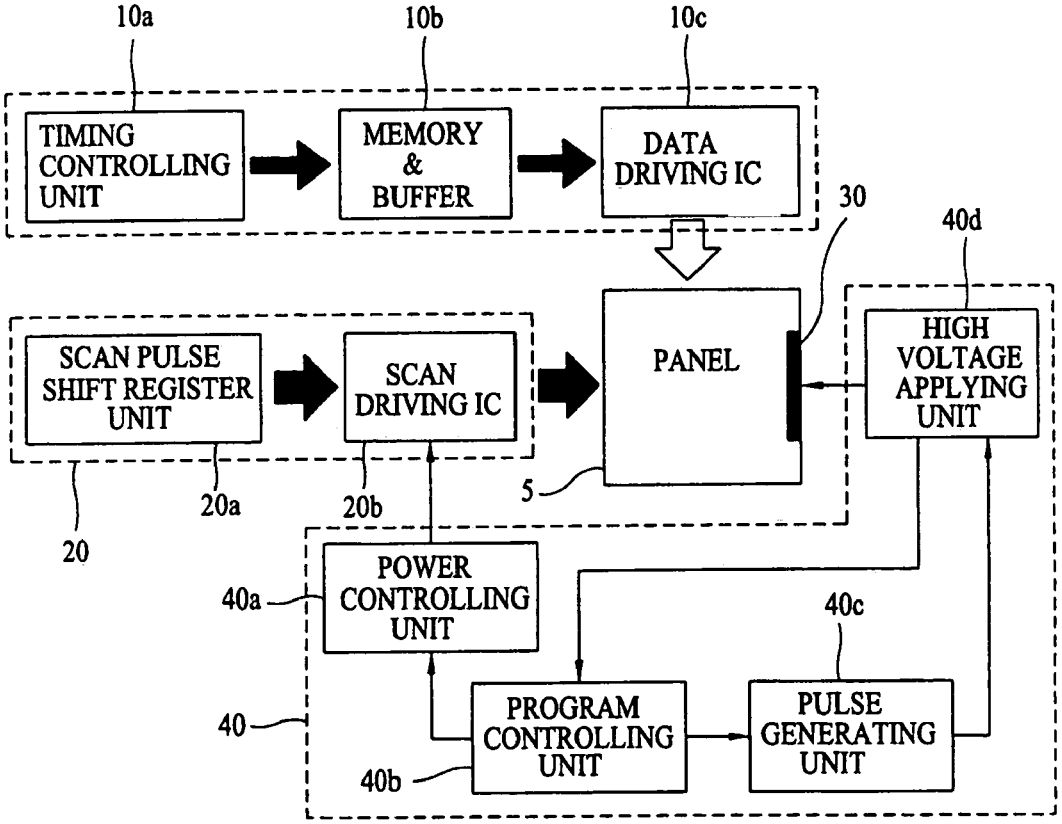
FIG. 2 is a block diagram showing a construction of an aging apparatus of the field emission device according to the present invention.

FIG. 2 is a block diagram showing a construction of an aging apparatus of the field emission device according to the present invention.

As shown, the aging apparatus of the field emission device comprises: a data driving unit 10 for outputting a timing control signal and a data pulse; a scan driving unit 20 for receiving a data signal and a clock signal inputted from outside by the timing control signal outputted from the data driving unit 10 and outputting a scan pulse; a panel 30 for receiving a data pulse outputted from the data driving unit 10 and a scan pulse outputted from the scan driving unit 20 and displaying data; and an aging operation controlling unit 40 for controlling a high voltage of a pulse form applied to the anode electrode 5 of the panel 30 and a voltage applied to the scan driving unit 20 and thereby performing an aging operation.

The aging apparatus of the field emission device will be explained in more detail.

The data driving unit 10 is composed of a timing controlling unit 10*a*, a memory and a buffer 10*b*, and a data driving IC 10*c*.

The scan driving unit 20 is composed of a scan pulse shift register unit 20*a* and a scan driving IC 20*b*.

The aging operation controlling unit 40 comprises: a power controlling unit 40*a* for applying a power to the scan driving unit 20 by an external power control signal; a pulse generating unit 40*c* for receiving an external pulse control signal and thereby outputting a pulse signal having a corresponding frequency and a duty cycle; a high voltage applying unit 40*d* for receiving a pulse signal from the pulse generating unit 40*c*, converting a direct current high voltage into an alternating current high voltage of a pulse form, and thereby applying to the anode electrode 5; and a program controlling unit 40*b* for detecting a voltage and a current applied to the anode electrode 5 of the panel 30 from the high voltage applying unit 40*d*, comparing the detected current value with a preset limitation current value, and outputting a pulse control signal and a power control signal to the pulse generating unit 40*c* and the power controlling unit 40*a*, respectively. The program controlling unit 40*b* and the power controlling unit 40*a*, the program controlling unit 40*b* and the pulse generating unit 40*c*, and the program controlling unit 40*b* and the high voltage applying unit 40*d* are connected to each other by a universal interface bus such as GPIB or HPIB.

The aging operation controlling unit 40 will be explained in more detail.

First, the high voltage applying unit 40*d* receives a pulse signal from the pulse generating unit 40*c* thus to perform a switching operation. To this end, the high voltage applying unit 40*d* comprises a switching means (not shown) for performing an on/off switching corresponding to the pulse signal, converting a direct current high voltage into an alternating current high voltage of a pulse form, and thereby outputting. That is, when the high voltage applying unit 40*d* performs an 'on' operation for the switching means, a direct current is supplied. However, when the high voltage applying unit 40*d* performs an, 'off' operation for the switching means, a direct current is not supplied to the anode. The switching means can include a switching controllable high voltage relay having an operation time of a ms unit, or a switching controllable semiconductor device having an operation time of a $\mu$s unit.

Also, the program controlling unit 40*b* is provided with a protecting means in preparation for a case that an excessive voltage or current are applied or arc is generated. For example, when a current fed back from the anode electrode 5 is detected and the detected current overflows than a preset limitation current, the program controlling unit outputs a pulse control signal for performing an off operation for the switching means of the high voltage applying unit 40*d* or stops a program. That is, the program controlling unit 40*b* prevents a high voltage from being applied to the anode electrode 5. Also, the program controlling unit 40*b* controls the power controlling unit 40*a* used at the time of performing the main aging thus to output a control signal for stopping a voltage supply to the scan driving unit.

Operation of the aging apparatus of the field emission device according to the present invention will be explained with reference to FIGS. 3A and 3B by being divided into a pre-aging and a main aging. The pre-aging means a process for removing a risk factor by performing an aging operation only with an anode voltage Va without an electron emission, and the main aging means a process for reducing an arc probability which can be later generated by emitting electrons after the anode voltage Va is supplied and thereby performing a current aging operation.

Figure 3A:
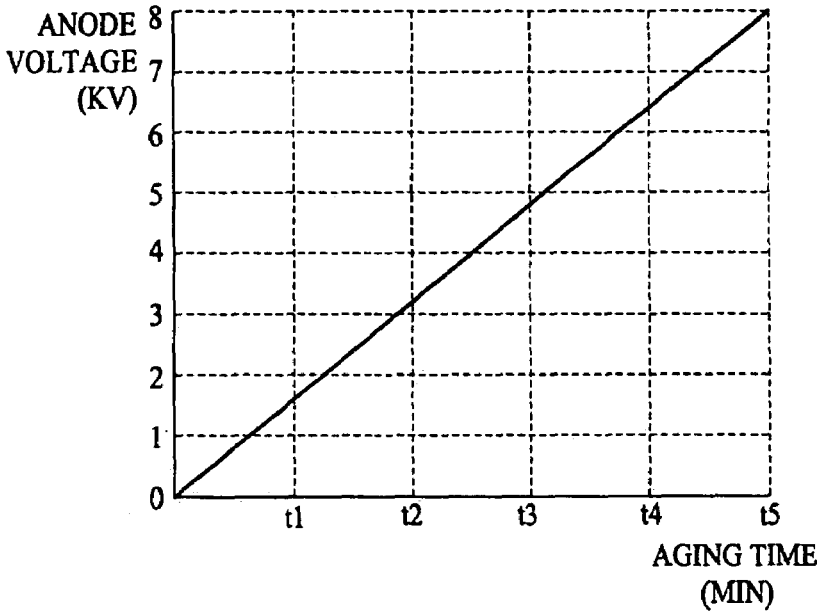
FIG. 3A is a graph comparing aging time for a direct current high voltage and a gradient.
Figure 3B:
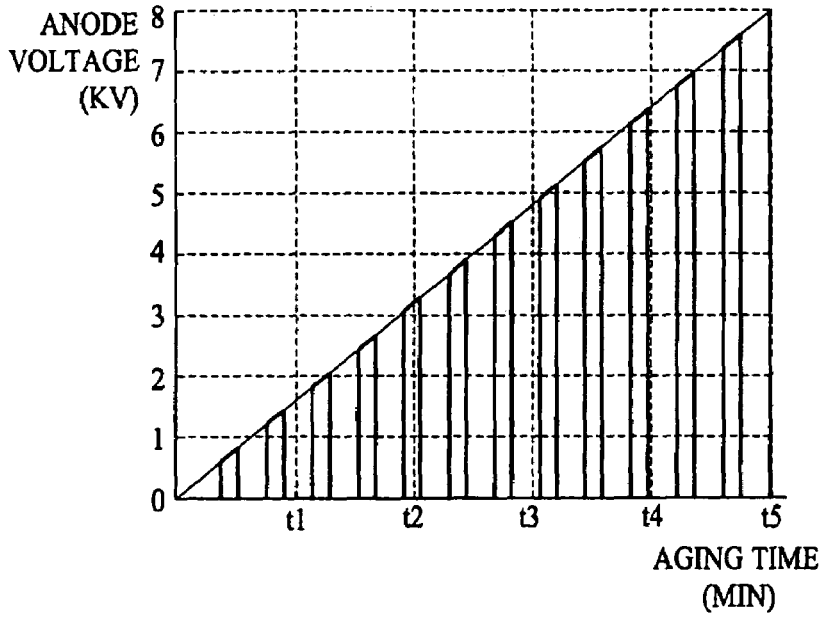
FIG. 3B is a graph showing a high voltage of a pulse form applied to an anode electrode according to aging time in the present invention.

FIG. 3A is a graph comparing aging time for a direct current high voltage and a gradient, and FIG. 3B is a graph showing a high voltage of a pulse form applied to an anode electrode according to aging time in the present invention.

First, the pre-aging process will be explained as follows.

When a gradually increased direct current high voltage is inputted to the switching means of the high voltage applying unit 40*d*, a pulse control signal is outputted from the program controlling unit 40*b*. The pulse generating unit 40*c* receives the pulse control signal thus to output a pulse signal having a preset frequency and a duty cycle. Then, by said outputted pulse signal, the switching means of the high voltage applying unit 40*d* is in power-on/off state. Accordingly, the switching means converts a direct current high voltage applied by being gradually increased shown in FIG. 4A into an alternating current high voltage of a pulse form shown in FIG. 4B thus to apply to the anode electrode 5 of the panel 30. For example, when an 'on' time of the pulse signal is 2 ms and an 'off' time is 8 ms, only a voltage corresponding to the 2 ms is inputted to the anode electrode 5 for 10 ms.

Meanwhile, the program controlling unit 40*b* detects a voltage and a current inputted from the high voltage applying unit 40*d* to the anode electrode 5 by a feed back, and compares the detected current value with a preset limitation current value. Herein, when the detected current value is greater than the limitation current, a high voltage applied to the anode electrode 5 becomes power off in order to reduce a device damage. That is, if the pulse generating unit 40*c* does not output a pulse signal, the switching means becomes power off and thereby a high voltage is not applied to the anode electrode 5. A timing setting value, a high voltage setting value, a gradient setting value, a limitation current setting value, and etc. for the direct current high voltage are stored as a table form at an inner memory of the program controlling unit 40*b* or the high voltage applying unit 40*d*. For example, if it is supposed that time is t1~t2, a gradient is 3, and a limitation current value is 100 mA when an inputted direct current high voltage is 2~2 KV, said data for a voltage are stored as a table form.

However, when the current value detected from the program controlling unit 40*b* is less than the limitation current value, the program controlling unit 40*b* outputs a pulse control signal for a switching signal to the pulse generating unit 40*c*. According to this, the pulse generating unit 40*c* outputs a pulse signal. Then, the high voltage applying unit 40*c* receives the pulse signal thus to turn on/off the switching means, thereby re-applying an increased high voltage to the anode electrode 5.

An alternating current pulse high voltage shown in FIG. 3B is applied to the anode electrode until it is applied to a preset maximum high voltage. Of course, said process is performed in a state that a sealing is not performed, and contaminants generated at the time of pre-aging are exhausted by a vacuum pump.

When the pre-aging operation is finished, the program controlling unit 40*b* performs a main aging operation. That is, during the main aging operation, the program controlling unit outputs a power control signal, and the power controlling unit 40*a* receives the power control signal thus to apply a corresponding power to the scan driving unit 20.

Then, by the power applied to the scan driving unit 20, the scan electrode 2 emits electrons thus to perform a current aging operation. Accordingly, contaminants are knocked off through the main aging operation are also exhausted by a vacuum pump.

When the pre-aging operation and the main aging operation are finished, the vacuum region of a high vacuum state is sealed. Therefore, differently from the conventional art where contaminants are removed by using getter, in the present invention, contaminants can be removed without using the getter.

Figure 4:
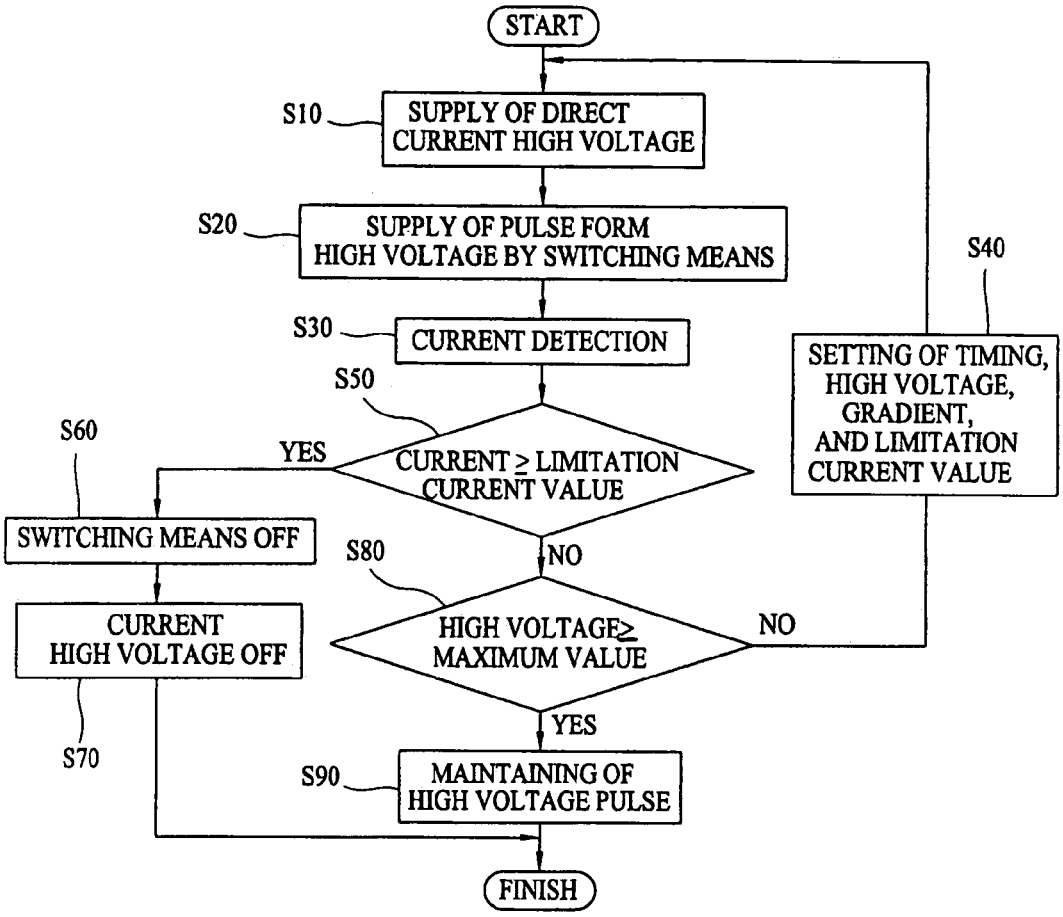
FIG. 4 is a flow chart showing an aging method of the field emission device according to the present invention.

FIG. 4 is a flow chart showing an aging method of the field emission device according to the present invention.

As shown, the aging method of the field emission device according to the present invention comprises the steps of: converting a gradually increasing direct current high voltage applied to an anode electrode into an alternating current high voltage of a pulse form by an external pulse signal and thereby applying (S10, S20); detecting a current and a voltage generated at the time of applying the pulse high voltage, comparing the detected current value with a preset limitation current value, and performing an off operation for the high voltage applied to the anode electrode when the detected current value is greater than the preset limitation current value (S30, S50, S60, S70); judging whether a high voltage applied to the anode electrode 5 is a preset maximum value when the detected current value is less than a preset limitation current value, and applying an increased pulse high voltage to the anode electrode when the high voltage applied to the anode electrode 5 is less than the preset maximum value (S30, S50, S80, S40); and judging whether a high voltage applied to the anode electrode is a preset maximum value, maintaining the pulse high voltage when the high voltage is greater than the preset maximum value, and thereby applying to the anode electrode (S80, S90).

Operation of the present invention will be explained as follows.

First, a direct current high voltage where time, a gradient, and a limitation current value are set is inputted to the switching means of the high voltage applying unit (S10). The inputted direct current high voltage is converted into an alternating current high voltage of a pulse form by the on/off switching means according to an external pulse signal, and applied to the anode electrode 5 (S20). Then, a voltage and a current applied to the anode electrode 5 are detected (S30), and the detected current value is compared with a preset limitation current value to judge whether a device damage can be generated (S50). That is, when the detected current value is more than the preset limitation current value, the switching means where a direct current high voltage is applied becomes power off (S60) and a direct current high voltage becomes power off (S70) thus to perform an off operation for the high voltage applied to the anode electrode 5. The high voltage can become power-off by another method that the program controlling unit 40*b* stops a program for performing the operation.

Also, when the detected current value is less than the preset limitation current value, it is judged whether the high voltage of a pulse form applied to the anode electrode 5 is a preset maximum value (S80). When the high voltage is less than the preset maximum value, preset time, gradient, limitation current value, and high voltage are again applied to the switching means (S40). Time, a gradient, and a limitation current value for an applied direct current high voltage are preset for the high voltage, and stored as a table form.

Said processes are repeated until the applied high voltage becomes more than the preset maximum value (S10~S50). When an alternating current high voltage applied to the anode electrode 5 is more than the maximum value, a pulse high voltage having the maximum value is maintained (S90).

Accordingly, the field emission device is operated in a state that the pulse high voltage having the maximum value is maintained (that is, pre-aging), and the power controlling unit 40*a* applies a power to the scan driving unit 20 thus to perform a current aging (that is, main aging) for the field emission device. At this time, contaminants generated at the time of the pre-aging and the main aging are exhausted by a vacuum pump at a vacuums state.

In the present invention, the on/off switching control is performed by receiving a direct current voltage, and the aging operation is performed by applying a high voltage of a pulse form to the anode electrode. At this time, a period is several hundreds of ms and a pulse on time is several tens of ms, which correspond to a several tenth of a duty ratio. That is, energy much less than the conventional energy used to supply a direct current power is used. Also, due to a pulse supply with less energy and short time for performing an aging operation, a panel damage can be prevented. For example, according to the conventional aging operation using a direct current high voltage, arc is generated at a panel when a voltage more than 2 KV is supplied. However, in an alternating current high voltage of a pulse form according to the present invention, arc is not generated even in a voltage more than 10 KV and time for performing an aging operation is very short. Also, in the conventional aging operation, more than 10 hours was required, whereas, in the present invention, all processes were finished within one hour.

According to the present invention, an aging operation is performed in a pre-aging step and a main aging step, respectively thus to remove contaminants, thereby prolonging a lifespan of a product and obtaining a reliability of a product. Also, a high voltage of a pulse form is applied, thereby reducing energy consumption and reducing aging time.

Even if only the pulse form was mentioned as one embodiment of the present invention, an alternating current waveform including each kind such as a serration waveform, a triangle waveform, a cylinder waveform, and a sine waveform can be applied to the present invention.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalence of such metes and bounds are therefore intended to be embraced by the appended claims.

What is claimed is:

1. An aging apparatus of a field emission device provided with a scan driving unit and a panel, the apparatus comprising:

an aging operation controlling unit for performing an aging operation by controlling a high voltage of a pulse form applied to an anode electrode of the panel and a voltage applied to the scan driving unit, wherein the aging operation controlling unit comprises:

a power controlling unit for applying a power to the scan driving unit by an external power control signal;

a pulse generating unit for receiving an external pulse control signal and thereby outputting a pulse signal having a corresponding frequency and a duty cycle;

a high voltage applying unit for receiving a pulse signal from the pulse generating unit, converting a direct current high voltage into an alternating current high voltage of a pulse form, and thereby applying to the anode electrode; and a program controlling unit for detecting a voltage and a current applied to the anode electrode of the panel from the high voltage applying unit, comparing the detected current value with a preset limitation current value, and outputting a pulse control signal and a power control signal to the pulse generating unit and the power controlling unit, respectively.

2. The apparatus of claim 1, wherein the program controlling unit and the power controlling unit, the program controlling unit and the pulse generating unit, and the program controlling unit and the high voltage applying unit are connected to each other by a universal interface bus.

3. The apparatus of claim 1, wherein the high voltage applying unit comprises a switching means for receiving a pulse signal from the pulse generating unit, switching a direct current high voltage into an alternating current high voltage of a pulse form, and thereby outputting.

4. The apparatus of claim 3, wherein the switching means is a high voltage relay which is switching-controllable as a ms unit, or a semiconductor device which is switching-controllable as a $\mu$s unit.

5. The apparatus of claim 1, wherein the program controlling unit detects a current fed back from the anode electrode thus to output a pulse control signal for performing an off operation for the high voltage applying unit or stops a program when the current fed back from the anode electrode overflows than a preset limitation current, and controls the power controlling unit thus to output a control signal for stopping a voltage supply to the scan driving unit.

6. The apparatus of claim 1, wherein the program controlling unit or the high voltage applying unit include an inner memory for storing a timing setting value, a high voltage setting value, a gradient setting value, a limitation current setting value, and etc. for the direct current high voltage.

7. An aging method of a field emission device provided with a scan driving unit and a panel, the method comprising:

a pre-aging for switching a direct current high voltage applied to an anode electrode of the panel and thereby outputting as an alternating current high voltage of a pulse from; and a main aging for controlling a voltage applied to the scan driving unit, wherein the pre-aging method comprises the steps of:

converting a gradually increasing direct current high voltage applied to an anode electrode into an alternating current high voltage of a pulse form by an external pulse signal and thereby applying, detecting a current and a voltage generated at the time of applying the pulse high voltage, comparing the detected current value with a preset limitation current value, and performing an off operation for the high voltage applied to the anode electrode when the detected current value is greater than the preset limitation current value, judging whether a high voltage applied to the anode electrode is a preset maximum value when the detected current value is less than a preset limitation current value, and applying an increased pulse high voltage to the anode electrode when the high voltage applied to the anode electrode is less than the preset maximum value, and judging whether a high voltage applied to the anode electrode is a preset maximum value, maintaining the pulse high voltage when the high voltage is greater than the preset maximum value, and thereby applying to the anode electrode.

8. The method of claim 7, wherein a direct current high voltage having preset time, gradient, and limitation current value is converted into a high voltage of a pulse form by an on/off switching means corresponding to an external pulse signal and thereby applied to the anode electrode in the step of converting into the alternating current pulse high voltage and thereby applying.

9. The method of claim 7, wherein the field emission device is operated in a state that the pulse high voltage having the maximum value is maintained (that is, pre-aging), and the power controlling unit applies a power to the scan driving unit thus to perform a current aging (that is, main aging) for the field emission device.

* * * * *